United States Patent [19]

Self

[11] Patent Number: 4,911,389

[45] Date of Patent: Mar. 27, 1990

[54] INSTRUMENT BRACKET ASSEMBLY

[76] Inventor: Michael Self, 5867 Auburn Blvd., No. 8, Sacramento, Calif. 95841

[21] Appl. No.: 282,602

[22] Filed: Dec. 12, 1988

[51] Int. Cl.[4] ..... A47F 5/02

[52] U.S. Cl. ..... 248/146; 248/172; 248/205.2; 248/205.3; 211/43

[58] Field of Search ..... 248/146, 149, 176, 172, 248/201, 205.2, 359 A, 205.3; 211/43

[56] References Cited

U.S. PATENT DOCUMENTS

| | | | |
|---|---|---|---|
| 1,750,576 | 3/1930 | Cubberley | 211/43 X |
| 2,294,595 | 9/1942 | Dice | 211/43 |
| 4,330,161 | 5/1982 | Khawand | 248/205.3 X |
| 4,712,693 | 12/1987 | Striplin | 248/205.2 X |

OTHER PUBLICATIONS

Damark International, Inc., products catalog; Nov. 1988.

*Primary Examiner*—3
*Assistant Examiner*—Alvin C. Chin-Shue
*Attorney, Agent, or Firm*—Joseph E. Gerber

[57] ABSTRACT

A bracket assembly retaining instruments in an orderly array is disclosed which incorporates two opposing subunits, each subunit having a side rail and one or more planar, parallel fingers at right angles to the side rail. The fingers are able to slide between each other and have adherent means upon their faces. A plurality of instruments are secured to the adherent means on the fingers to form a rigid, orderly array.

9 Claims, 8 Drawing Sheets

INSTRUMENT BRACKET ASSEMBLY

BACKGROUND OF THE INVENTION

1. Field Of The Invention:

The present invention relates generally to brackets, and more particularly to brackets for holding instruments in place.

2. Description Of The Related Art

During work and recreation, many people find it necessary to manipulate and have accessible more than one hand-held instrument at a time. For example, most modern homes have one or more of the following entertainment devices: a television, a video tape player-recorder, a stereo sound system, a compact disc player or a laser disc player. All these are now available with wireless remote control units. It is not uncommon to need more than one remote control unit at a time, especially when using interactive devices such as televisions and video tape machines. This often creates a problem because every time the viewer or listener wishes to change the entertainment environment from his or her seat the correct remote control unit, or combination of remote control units, must be located. Each unit being separate, they tend to get misplaced, confused with one another or buried under other items such as newspapers, pizza boxes and the like. Further, once misplaced, a greater risk of damage arises because they are more easily dropped, stepped-on or damaged by liquids.

Modern technology has made many other instruments of similar size available. These are sometimes tailored to use for particular types of analysis such as those becoming known in the medical or automotive arts. Other hand-sized electronic instruments include mathematical calculators, tape recorders, and small radios and televisions. Hand-held electronic dictionaries, thesauri and foreign language translators are also available now. One needs only to speculate as to the possible range of needs that may be met by having two or more of the foregoing instruments close at hand.

Consequently, it appears that there exists a need for a device to bind instruments such as the foregoing together for convenient use. This has recently been achieved electronically in the field of remote control units for entertainment devices, a single master unit being tuned for control of all a user's various entertainment devices. However, this is fairly expensive and usually wasteful of that part of the cost of those entertainment devices with which a remote control is supplied at the time of purchase. Further, in many instances it would neither be practical nor economical to produce novel hybrid electronic instruments to fit one's particular needs.

It is perhaps more reasonable to attempt to bind the desired instruments together in a physical rather than an electronic way. But, simply wrapping tape, rubber bands, wire, string or the like around instruments must allow for free use of all the control buttons; this is therefore impractical in most cases.

To address this problem, at least one device, as shown in U.S. Pat. No. 4,610,054 to Mailan, suggests binding instruments side-by-side on a planar surface with the aid of mechanically interlocking fabric strips. This is disclosed in combination with a clipboard for a paper pad. However, Malian and the rest of the art fail to provide means for securely binding a plurality of instruments into an integrated array of custom-tailored size having means to prevent accidental disassembly, while retaining the ability to accommodate the further addition or removal of instruments.

SUMMARY OF THE INVENTION

The instrument bracket assembly of the present invention is adapted to overcome the above-noted shortcomings, as well as to provide a simple and inexpensive way of addressing those perceived needs.

The preferred instrument bracket claimed herein includes two subparts, each having an elongated side rail with one or more fingers bound to and extending outward at right angles from the side rail. Each finger has a flat upper surface, the width of its side rail projecting above said surface and the length of its side rail being in parallel relation to said surface. Each finger also has adherent means on said surface to which an instrument may be temporarily secured.

Interaction of the foregoing elements and structural integrity of the bracket assembly are realized when instruments are secured to the subparts. Specifically, the subparts are placed on a flat surface so their side rails are in parallel relation, and so the fingers of each are fit between the fingers of the other. The side rails are then placed in proper distance apart to receive the desired instruments in side by side relation. The instruments are then pressed into contact with the flat upper surfaces of said fingers, binding the adherent means of the fingers to the nether faces of the instruments. This yields an instrument bracket assembly where the instruments are secured in a rigid yet repeatedly adjustable array.

Since the side rails are rigidly bound to the fingers and extend upward therefrom, they effectively cover the side edges of the instruments at both ends of the array. Thus, the instruments are prevented from being disengaged from the bracket when the array is grasped by either of the side rails. Therefore, it is an object of the present invention to provide an easily and repeatedly adjustable bracket for retaining instruments in an orderly array, addition of one or more instruments to said bracket's initially disjoined subparts serving to transform said subparts into a rigid trough cradling said instruments.

DESCRIPTION OF THE PREFERRED EMBODIMENTS

Figures 1, 2:
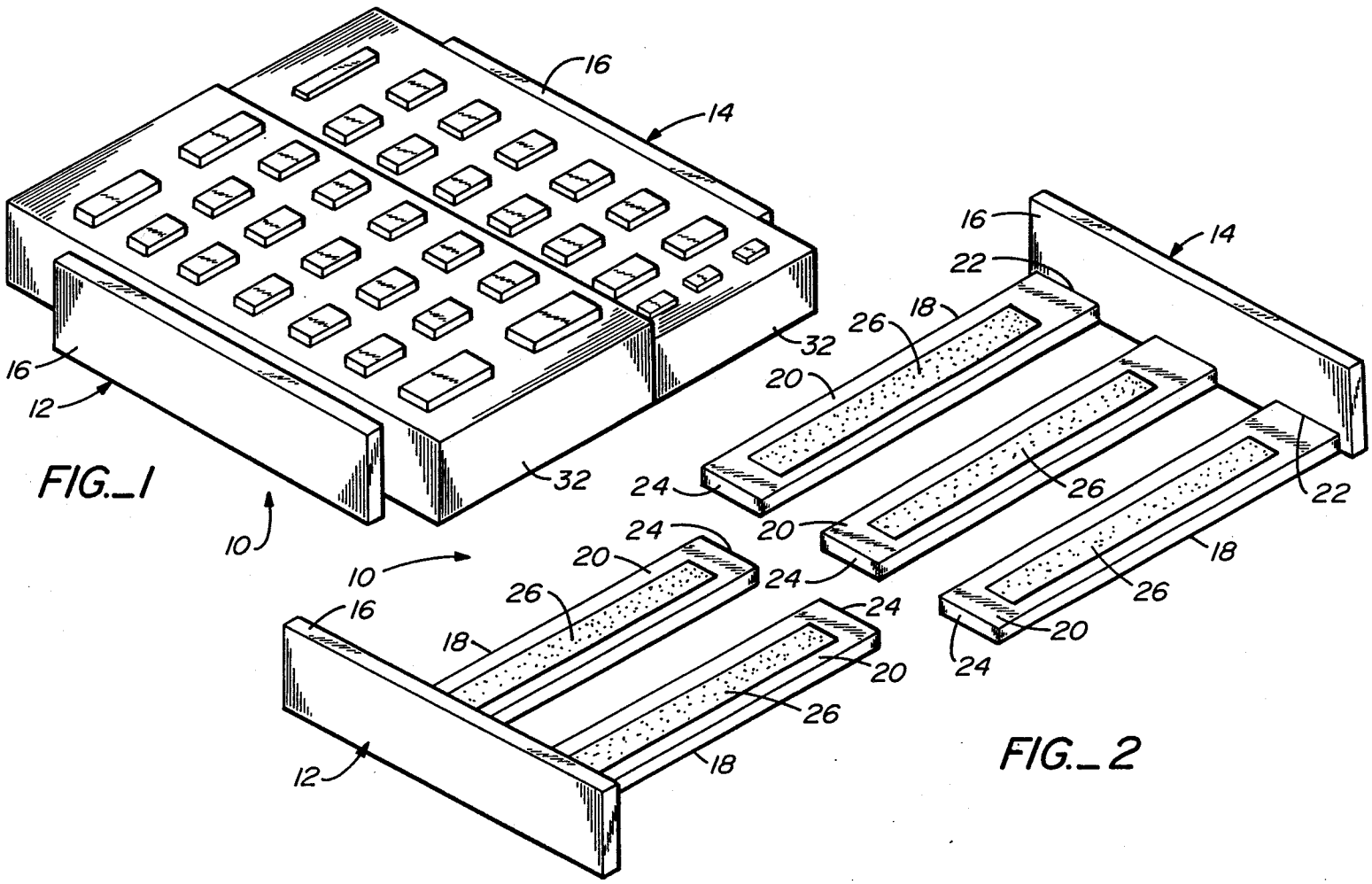
FIG. 1 is a perspective view of two instruments secured to the inventive bracket.
FIG. 2 is a perspective view of the two subparts of the inventive instrument bracket of FIG. 1 as they exist separately before being secured together by one or more instruments.

Referring now specifically to the drawings, FIGS. 1 and 2 show the preferred inventive instrument bracket generally referred to by reference numeral 10. Instrument bracket 10 is comprised of first and second opposing subparts, 12 and 14 respectively. Each subpart includes a rigid, elongated, generally rectangular side rail 16 and a plurality of rigid, elongated, generally rectangular, planar fingers 18. Fingers 18 are all of similar length, each having a planar upper surface generally referred to as its binding face 20, a proximal end 22 and a distal end 24. Each side rail 16 is bound to the proximal end 22 of a plurality of fingers 18, said fingers being parallel and in the same plane as each other. The proximal end 22 of each finger 18 meets its respective side rail 16 in perpendicular relation, said side rail being rigidly bound to said end. Thus, each side rail's length is parallel to the plane of the faces 20 of the fingers to which it is bound, and the width of each is upstanding from that same plane at each finger's proximal end.

As is best shown in FIG. 2, fingers 20 are arranged on and bound to their respective subparts in a manner that allows their distal ends 24 to intercalate between the fingers of the other. Specifically, fingers 20 are arranged with spaces between them equal to the width of the opposing finger on the other support.

Figure 3:
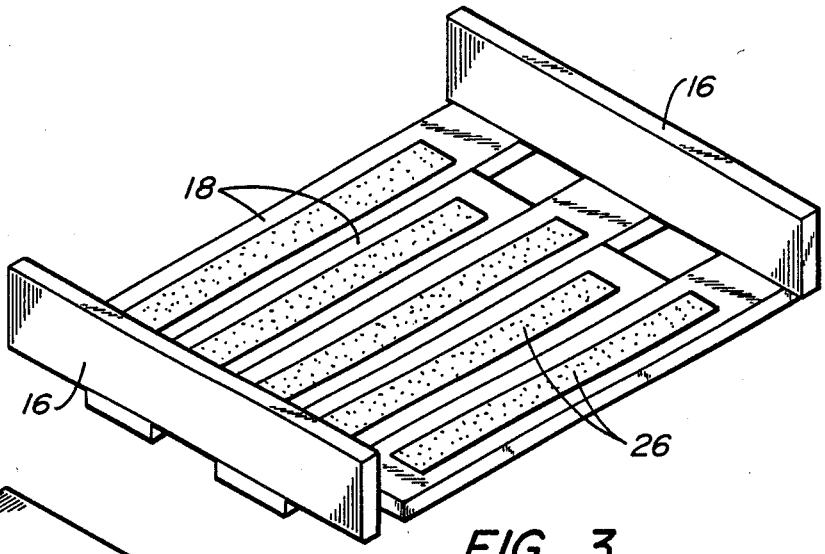
FIG. 3 is a perspective view of an alternative instrument bracket with the fingers of its subparts attached to the narrow edges, rather than the wider faces, of its side rails.

FIG. 3 shows an alternative embodiment of the invention wherein the proximal ends 22 of fingers 18 are bound to the narrow edges of side rails 16 rather than to their wider faces. This is the easiest embodiment to construct when stock on hand includes separate finger and side rail pieces. These are simply joined with glue. The rest of the figures herein show each subunit as a single, molded piece; the finger ends simply abut the faces of the side rails. This is expected to be simpler to mass produce; however, the embodiment of FIG. 3 should be considered to fall equally within the scope of the invention.

Adherent means is disposed upon the binding face 20 of each finger 18. When the distal ends of the fingers of the first and second subparts are intercalated as in FIG. 3, a U-shaped trough is formed as seen in the end elevation of FIG. 4. Placement of one or more solid bodies across the adherent means of the several fingers forming the bottom of this trough effectively binds said subparts together and gives bracket 10 integrity and rigidity.

Figure 5:
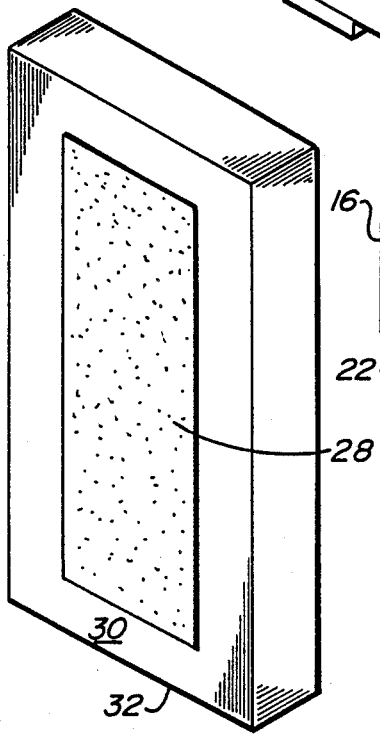
FIG. 5 is a perspective of an instrument with a patch of mechanically interlocking fabric on its nether face.
Figure 6:
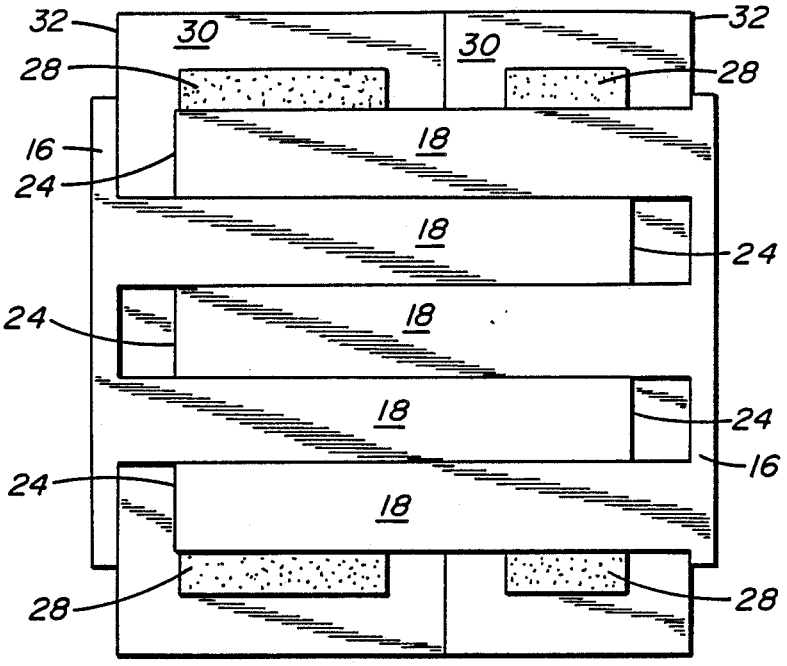
FIG. 6 is a bottom plan view showing the nether faces of two instruments secured to the inventive bracket.

The preferred adherent means on each face 20 is a first patch of a pair of mating mechanically interlocking fabric patches 26, such as are sold under the trademark VELCRO. Either the familiar "hooked" portion or the "looped" portion is acceptable, as long as the same is used on all faces 20. And, for example as in FIG. 5 if a mating, second patch of mechanically interlocking fabric 28 is disposed upon the nether face 30 of an instrument such as hand-held electronic instrument 32, and said instrument is laid across the intercalated fingers of both subparts with its nether face down, the subparts of bracket 10 will be secured into fixed relation with one another as well as to instrument 32. Further, if, as in FIGS. 1, 4 and 6, a plurality of instruments 32 bearing interlocking fabric 28 on their nether faces are arranged in a array and secured to the intercalated fingers of the subparts, a neat, rigid instrument bracket assembly results.

Other adherent means such as adhesives which remain tacky and never "set" may also be used with success. Of course, such adhesive would only be necessary upon the binding face 20 of fingers 18; this obviates use of mating adherent means on the nether faces of the instruments.

Figure 4:
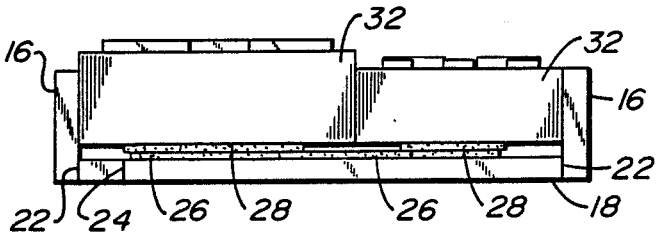
FIG. 4 is an end elevational view of the bracket and secured instruments shown in FIG. 1.

It will be realized that once a plurality of instruments are secured into a rigid bracket assembly, the assembly may be picked up and handled freely as a unit. As shown in FIGS. 1 and 4, side rails 16 serve to prevent disengagement of instruments 32 from the rest of the bracket because they cover the edges most likely to be grasped when one is picking up the array for use.

If its fingers are long enough, the inventive bracket 10 will accommodate any number of instruments desired, and will bind them into an array having side rails snugly covering both ends of the array. Once bound the instruments are easier to use because they remain in the same place in the array, thereby causing the collection of individual instruments to function more as a single "control panel."

Even irregularly shaped instruments may be bound to bracket 10 as long as they have a planar face able to carry a mating fabric patch and are of sufficient size to span and bind to several fingers 18. However, rectangularly shaped instruments make the most orderly array.

It is also contemplated that instruments larger than those of hand-held size may be bound together in a similar manner with a larger version of bracket 10.

Figure 7:
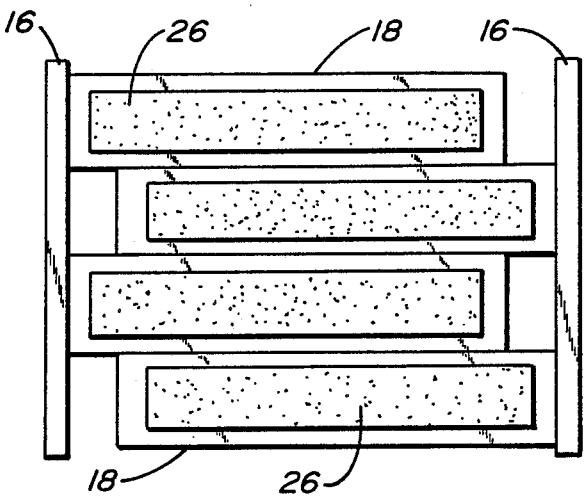
FIG. 7 is a plan view of an alternative instrument bracket having identical subunits.

Another embodiment, as shown in FIG. 7, employs two identical subunits. This simplifies manufacturing.

Figure 8:
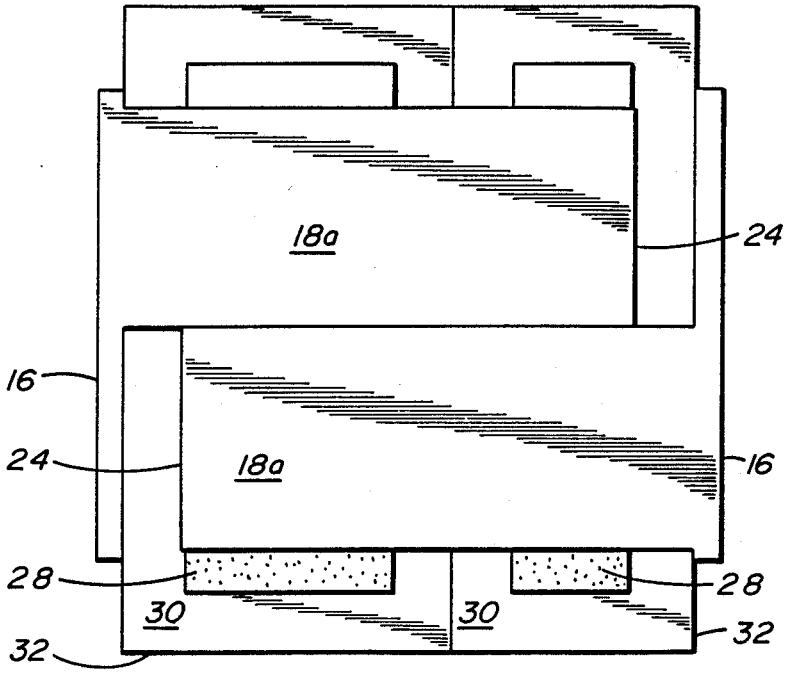
FIG. 8 is a bottom plan view showing the nether faces of two instruments secured to an alternative bracket, each subpart having a single wide finger bound to its side rail.

And finally, it will be realized that the essence of the inventive bracket's advantages may be exploited even if the subparts only carry a single finger apiece. These fingers 18a would preferably be rather wide, as shown in FIG. 8, to give the desirable amount of strength to the bracket when bound into an array.

In use, the width is best adjusted between the side rails 16 of bracket 10 by first placing opposing subparts 12 and 14 on a level surface with their fingers 18 intercalating between one another. The instruments to be bound into the array are then laid between the side rails with their mating patch-bearing nether faces up, in side-by-side relation, so the distance between side rails 16 may be tailored to the collective width of the instruments. Then, one-by-one the instruments are turned over and pressed into binding relation with the fingers 18, and thus with the subparts of bracket 10.

The foregoing detailed disclosure of the inventive instrument bracket 10 is considered as only illustrative of the preferred embodiment of, and not a limitation upon the scope of, the invention. Those skilled in the art will envision many other possible variations of the structure disclosed herein that nevertheless fall within the scope of the following claims. And, alternative uses for this instrument bracket may later be realized. Accordingly, the scope of the invention should be determined with reference to the appended claims, and not by the examples which have herein been given.

REFERENCE NUMERAL LIST

10 instrument bracket
12 first subpart
14 second subpart
16 side rail
18 finger
**18*a*** alternative wide finger
20 binding face of finger
22 proximal finger end
24 distal finger end

26 first velcro patch
28 second velcro patch
30 nether face of electronic instrument
32 hand-held electronic instrument

I claim:

1. An instrument bracket assembly comprising, in combination:

a. a pair of opposing rigid subparts, each separately comprising:
   i. at least one elongated finger having a planar binding surface;
   ii. an elongated side rail bound to an end of said finger at a right angle, the length of said side rail being parallel to the plane of said finger's binding surface and the width of said side rail extending above said surface;
   iii. releasable adherent means on said finger's binding surface; and, b. a plurality of instruments secured across said fingers' binding surfaces, between said opposing subparts' side rails, yielding a rigid yet repeatedly adjustable array.

2. The bracket assembly of claim 1, wherein said subparts are proportioned to accommodate hand-held electronic instruments.

3. The bracket assembly of claim 1, wherein at least one of said subparts has a plurality of fingers.

4. The bracket assembly of claim 1, wherein said subparts each have a plurality of fingers.

5. The bracket assembly of claim 1, wherein said adherent means comprises a looped fabric strip suitable for securely mating with a hooked fabric strip bound to an instrument, each strip being one of a pair of mating strips of mechanically interlocking fabric.

6. The bracket assembly of claim 1, wherein said adherent means comprises a hooked fabric strip suitable for securely mating with a looped fabric strip bound to an instrument, each strip being one of a pair of mating strips of mechanically interlocking fabric.

7. The bracket assembly of claim 1, wherein said adherent means comprises an interlocked mating pair of mechanically interlocking fabric strips, the backing of one strip being bound to said binding surface of said finger, the backing of the mating strip being exposed for adhesively securely binding to an instrument.

8. The bracket assembly of claim 1, wherein said adherent means comprises a tacky adhesive.

9. The bracket assembly of claim 1, wherein said subunits are of the same shape and dimensions.

* * * * *